US011197592B2

(12) United States Patent
Zhou et al.

(10) Patent No.: US 11,197,592 B2
(45) Date of Patent: Dec. 14, 2021

(54) VACUUM CLEANER

(71) Applicant: TTI (MACAO COMMERCIAL OFFSHORE) LIMITED, Macao (CN)

(72) Inventors: Rong Zhou, Jiangsu (CN); David Khalil, Jr., College Park, MD (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 17/055,779

(22) PCT Filed: Jul. 19, 2018

(86) PCT No.: PCT/CN2018/096301

§ 371 (c)(1),
(2) Date: Nov. 16, 2020

(87) PCT Pub. No.: WO2020/014922

PCT Pub. Date: Jan. 23, 2020

(65) Prior Publication Data

US 2021/0228033 A1 Jul. 29, 2021

(51) Int. Cl.
*A47L 5/28* (2006.01)
*A47L 9/00* (2006.01)
(Continued)

(52) U.S. Cl.
CPC ..... *A47L 5/28* (2013.01); *A47L 9/009* (2013.01); *A47L 9/26* (2013.01); *A47L 9/2884* (2013.01); *A47L 9/325* (2013.01)

(58) Field of Classification Search
CPC ..... A47L 5/28; A47L 9/009; A47L 9/2884; A47L 9/325
See application file for complete search history.

(56) References Cited

U.S. PATENT DOCUMENTS 5,361,879 A * 11/1994 Lin ..... B65H 75/403 191/12.4
6,363,571 B1 4/2002 Block et al.
(Continued)

FOREIGN PATENT DOCUMENTS

CN 201308448 Y 9/2009
CN 201505097 U 6/2010
(Continued)

OTHER PUBLICATIONS

International Search Report and Written Opinion for Application No. PCT/CN2018/096301 dated Apr. 18, 2019 (9 pages).
(Continued)

*Primary Examiner* — Dung Van Nguyen
(74) *Attorney, Agent, or Firm* — Michael Best & Friedrich LLP

(57) ABSTRACT

A vacuum cleaner (10) includes a handle assembly (22) pivotally coupled to a foot (42). The handle assembly (22) includes an air treatment member, an actuator (34) centrally arranged on a rear side of the handle assembly (22) and a cord reel assembly (14) arranged on a front side of the handle assembly (22). The cord reel assembly (14) includes a cord reel (30) and a cord (26) configured to be coupled to an AC power source and provide power to the suction source. The cord reel (30) is switchable between a first state, in which the cord reel (30) winds the cord (26), and a second state, in which the cord reel (30) does not wind. The actuator (34) is moveable between a first position and a second position. In response to the actuator (34) moving from the first position to the second position, the cord reel (30) switches from the second state to the first state.

27 Claims, 8 Drawing Sheets

(51) Int. Cl.

| | |
|---|---|
| ***A47L 9/26*** | (2006.01) |
| ***A47L 9/28*** | (2006.01) |
| ***A47L 9/32*** | (2006.01) |

(56) References Cited

U.S. PATENT DOCUMENTS

| | | | | |
|---|---|---|---|---|
| 6,574,827 | B2 | 7/2003 | Hashizume et al. | |
| 6,588,051 | B2 | 7/2003 | Hashizume et al. | |
| 6,678,916 | B2 | 1/2004 | Hashizume et al. | |
| 6,779,229 | B2 | 8/2004 | Lee et al. | |
| 7,739,772 | B2 | 6/2010 | Park | |
| 7,992,252 | B2 | 8/2011 | Park et al. | |
| 8,528,163 | B2 | 9/2013 | Park et al. | |
| 8,881,343 | B2 | 11/2014 | Park et al. | |
| 9,265,392 | B2 | 2/2016 | Seo et al. | |
| 2010/0325832 | A1 | 12/2010 | Yoo et al. | |
| 2011/0209302 | A1* | 9/2011 | Seo | A47L 9/2857 15/323 |
| 2012/0167333 | A1 | 7/2012 | Hawkins et al. | |
| 2012/0167335 | A1* | 7/2012 | Marsh | A47L 9/0444 15/347 |
| 2013/0117961 | A1* | 5/2013 | Doerfler | A47L 5/28 15/323 |
| 2015/0093973 | A1 | 4/2015 | Sergyeyenko et al. | |
| 2016/0073843 | A1 | 3/2016 | Seo et al. | |
| 2017/0290482 | A1 | 10/2017 | Hu et al. | |
| 2019/0059673 | A1* | 2/2019 | Tran | A47L 9/122 |

FOREIGN PATENT DOCUMENTS

| | | | |
|---|---|---|---|
| CN | 203042123 | U | 7/2013 |
| CN | 203861135 | U | 10/2014 |
| CN | 203861145 | U | 10/2014 |
| CN | 203898202 | U | 10/2014 |
| CN | 104736033 | A | 6/2015 |
| CN | 204722973 | U | 10/2015 |
| CN | 106998976 | A | 1/2017 |
| CN | 108065862 | A | 5/2018 |
| CN | 108135416 | A | 6/2018 |
| JP | 2001070204 | A | 3/2001 |

OTHER PUBLICATIONS

Chinese Patent Office Action for Application No. 201880094572.7 dated Aug. 20, 2021 (11 pages including statement of relevance).

* cited by examiner

VACUUM CLEANER

FIELD OF THE INVENTION

The present invention relates to vacuum cleaners, and more particularly to vacuum cleaners including electrical cord reels.

BACKGROUND OF THE INVENTION

Vacuum cleaners often include a cord that is extendable from a body of the vacuum cleaner and the cord is connected to an AC power source to provide power to a suction motor. An actuator may be provided on the body to reel the cord back to the body of the vacuum cleaner.

SUMMARY OF THE INVENTION

A vacuum cleaner is disclosed comprising a foot including a suction opening, a suction source and a dirt collection chamber in fluid communication with the suction opening and the suction source. The vacuum cleaner further comprises a handle assembly pivotally coupled to the foot for movement between an upright position and an inclined position. The handle assembly includes an air treatment member, an actuator centrally arranged on a rear side of the handle assembly, and a cord reel assembly arranged on a front side of the handle assembly. The cord reel assembly includes a cord reel and a cord configured to be coupled to an AC power source and provide power to the suction source, the cord reel switchable between a first state, in which the cord reel winds the cord, and a second state, in which the cord reel does not wind. The actuator is moveable between a first position and a second position. In response to the actuator moving from the first position to the second position, the cord reel switches from the second state to the first state.

Also disclosed is a vacuum cleaner comprising a foot including a suction opening, a suction source, a dirt collection chamber in fluid communication with the suction opening and the suction source, and a conduit fluidly coupling the suction opening to the dirt collection chamber. The vacuum cleaner also comprises a handle pivotally coupled to the foot for movement about a pivot axis between an upright position and an inclined position. The vacuum cleaner also comprises a steering assembly coupled between the handle and the foot. The steering assembly defines an axis of rotation transverse to the pivot axis. The handle is rotatable about the rotation axis relative to the foot. The vacuum cleaner further comprises a cord reel assembly including a cord reel and a cord that is configured to be coupled to an AC power source and provide power to the suction source. The cord reel is switchable between a first state, in which the cord reel winds the cord, and a second state, in which the cord reel does not wind. The vacuum cleaner also comprises an actuator moveable between a first position and a second position. In response to the actuator moving from the first position to the second position, the cord reel switches from the second state to the first state.

In yet another aspect, a vacuum cleaner is disclosed comprising a foot including a suction opening, a suction source, and a dirt collection chamber in fluid communication with the suction source. The vacuum cleaner also comprises a handle pivotally coupled to the foot for movement between an upright position and an inclined position. The vacuum cleaner also comprises an air path fluidly coupling the suction opening to the suction source, the air path at least partially within the handle. The vacuum cleaner further comprises a cord reel assembly including a cord reel and a cord that is configured to be coupled to an AC power source and provide power to the suction source. The cord reel is arranged on a front side of the handle and is switchable between a first state, in which the cord reel winds the cord, and a second state, in which the cord reel does not wind. The vacuum cleaner also comprises an actuator moveable between a first position and a second position. The actuator is arranged on a rear side of the handle. The vacuum cleaner also comprises a linkage coupling the actuator to the cord reel. The linkage is positioned external to the air path and is movable between a first position, corresponding to the first position of the actuator, and a second position, corresponding to the second position of the actuator, in which the linkage switches the cord reel from the second state to the first state.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
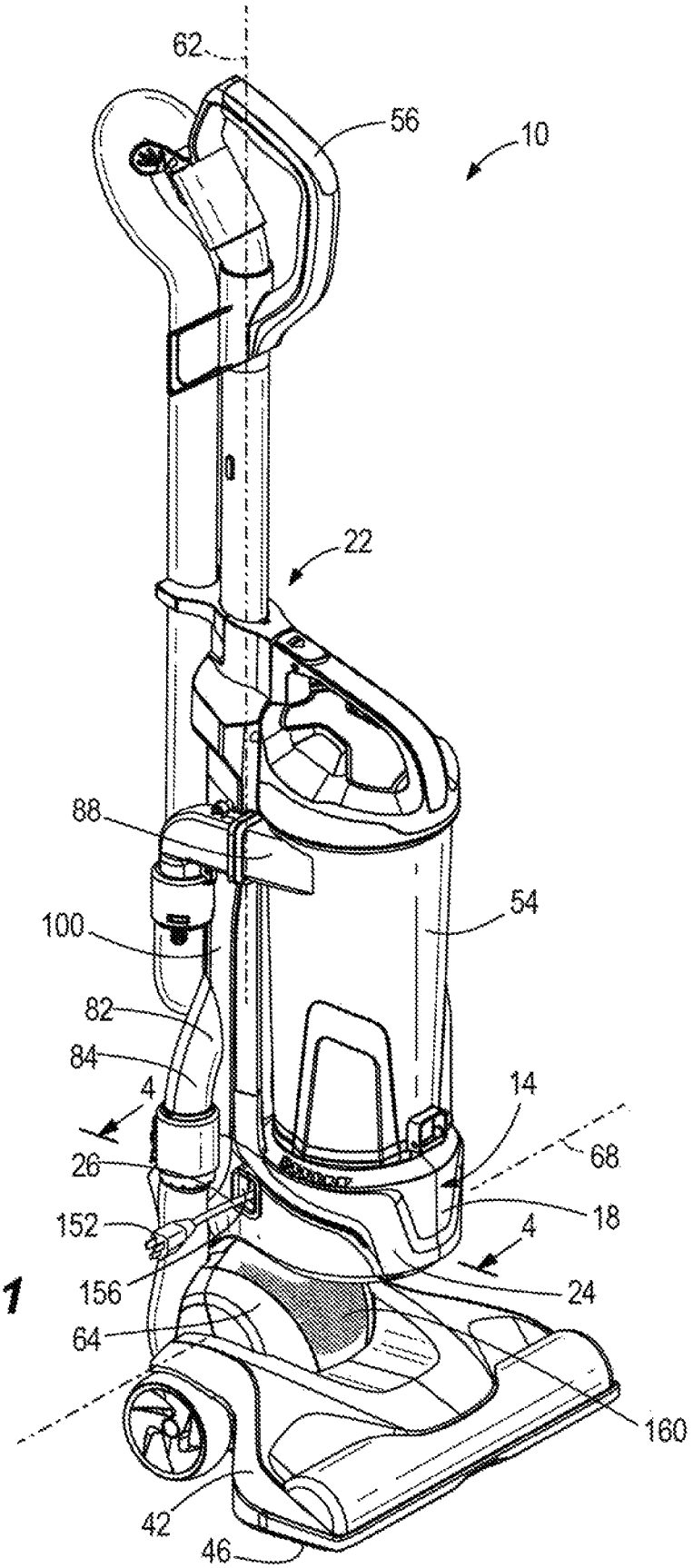
FIG. 1 is a perspective view of a vacuum cleaner.
Figure 2:
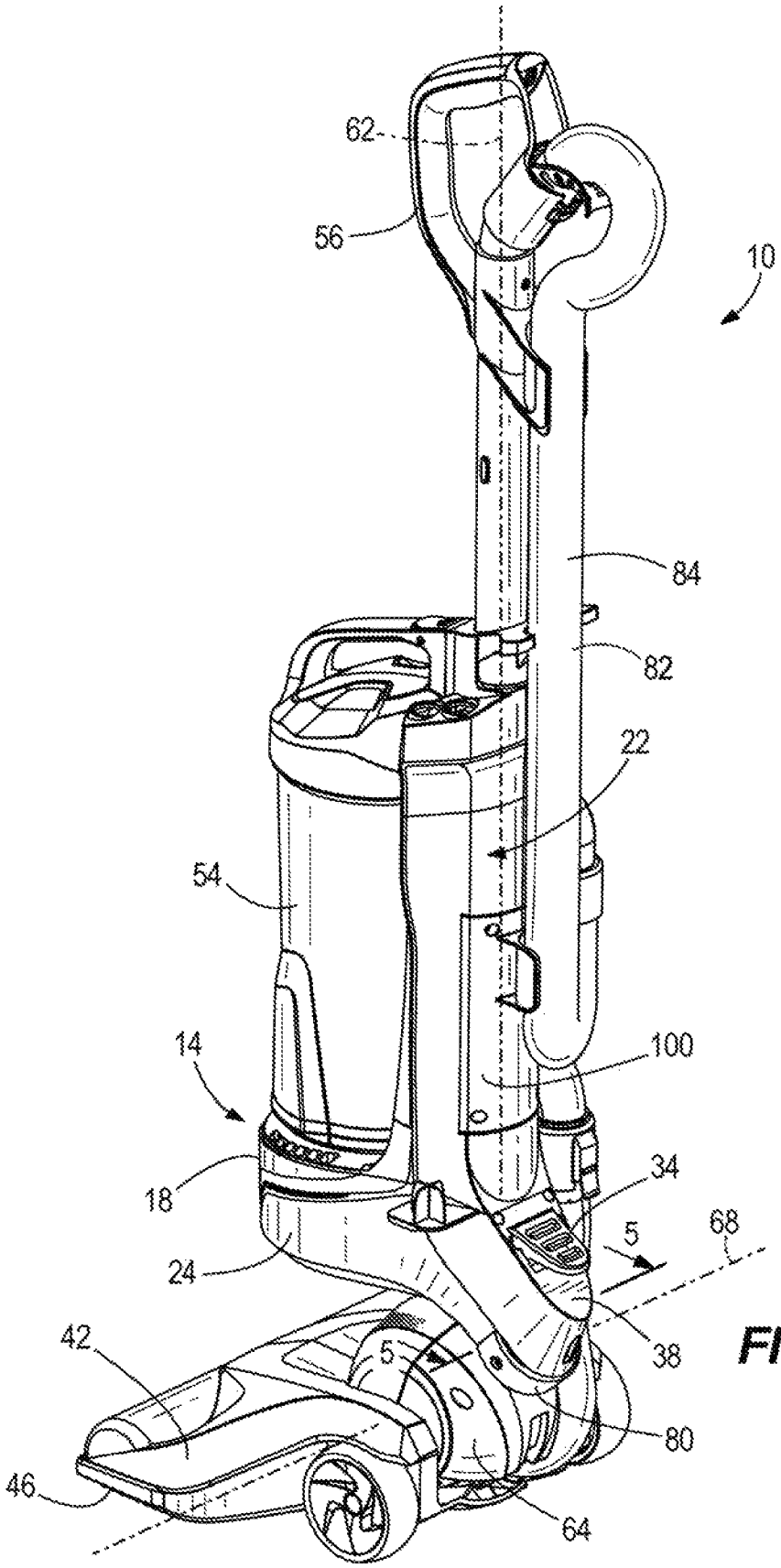
FIG. 2 is a rear perspective view of the vacuum cleaner of FIG. 1.

FIG. 1 illustrates a vacuum cleaner 10. As shown in FIGS. 1-4, 6 and 7, and as explained in further detail below, the vacuum cleaner 10 includes a cord reel assembly 14 arranged on a front side 18 of a handle assembly 22. The cord reel assembly 14 includes a housing 24, a cord 26 and a cord reel 30 that is switchable between a first state, in which the cord reel 30 winds the cord 26, and a second state, in which the cord reel 30 does not wind the cord 26. As shown in FIG. 2, an actuator 34 is arranged on a rear side 38 of the handle assembly 22 and is moveable between a first position and a second position. Movement of the actuator 34 from the first position to the second position switches the cord reel 30 from the second state to the first state.

Figure 4A:
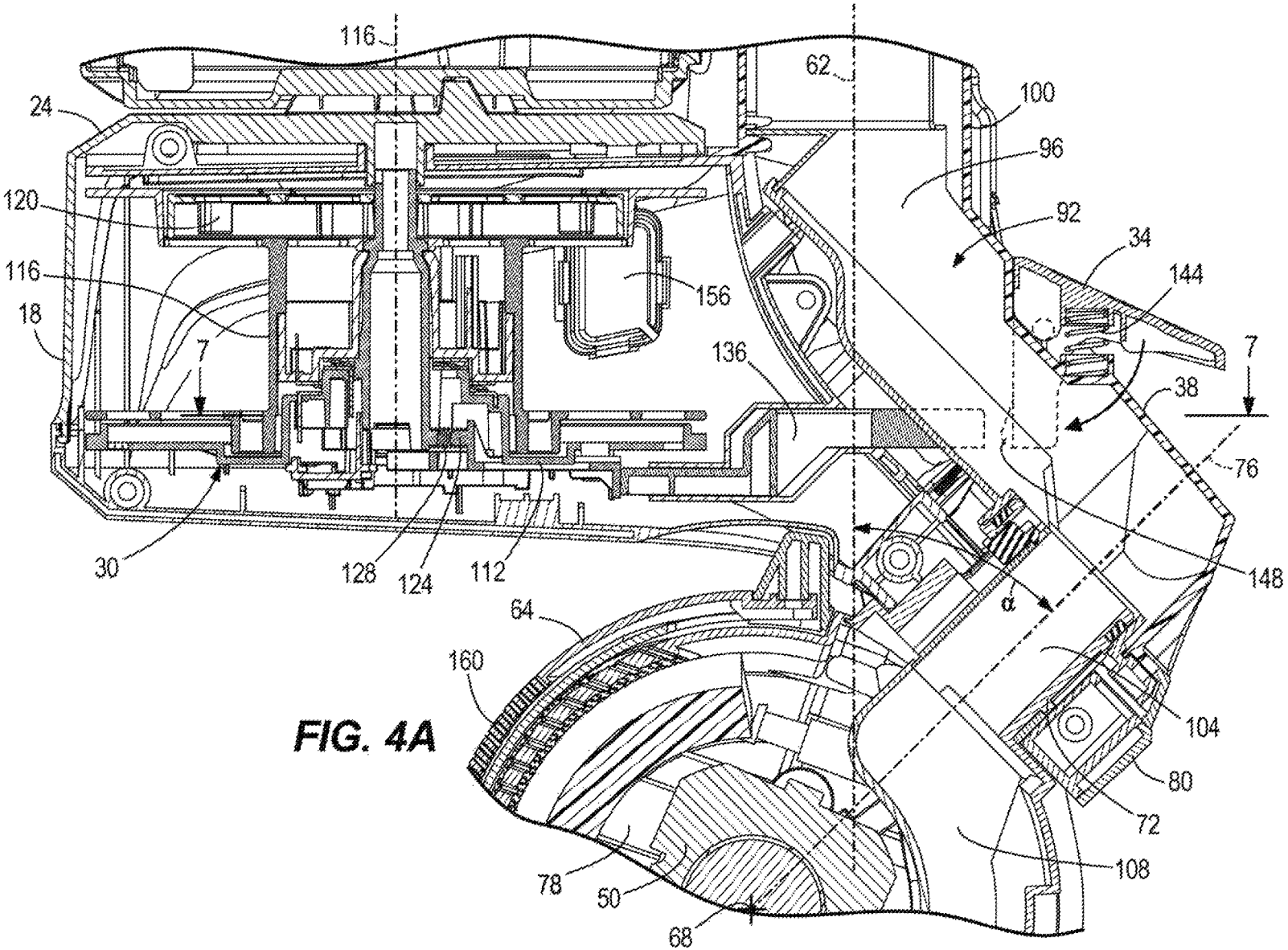
FIG. 4A is a cross-sectional view of the vacuum cleaner of FIG. 1 taken along line 4-4 of FIG. 1.
Figure 4B:
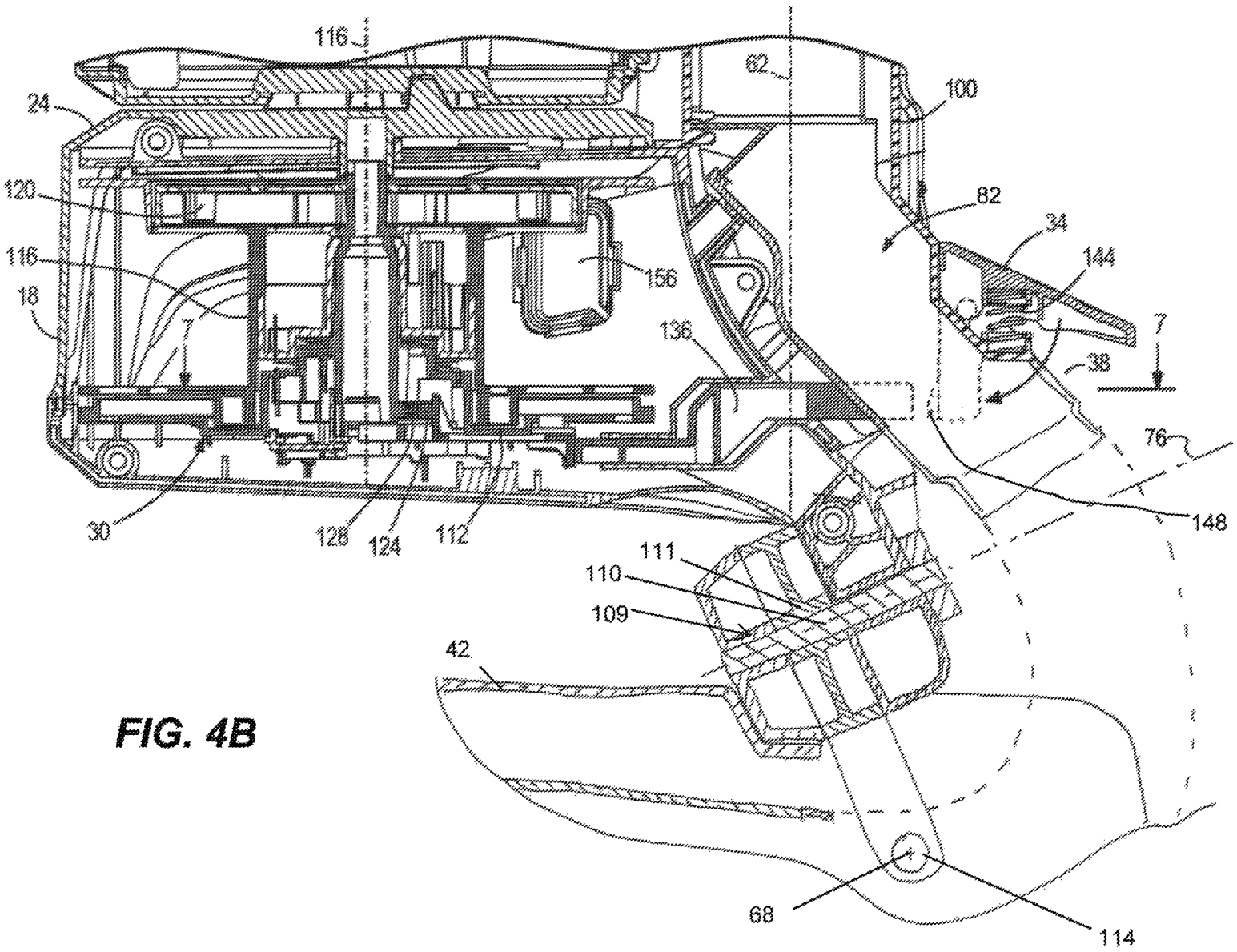
FIG. 4B is a cross-sectional view of another embodiment of a vacuum cleaner.
Figure 5:
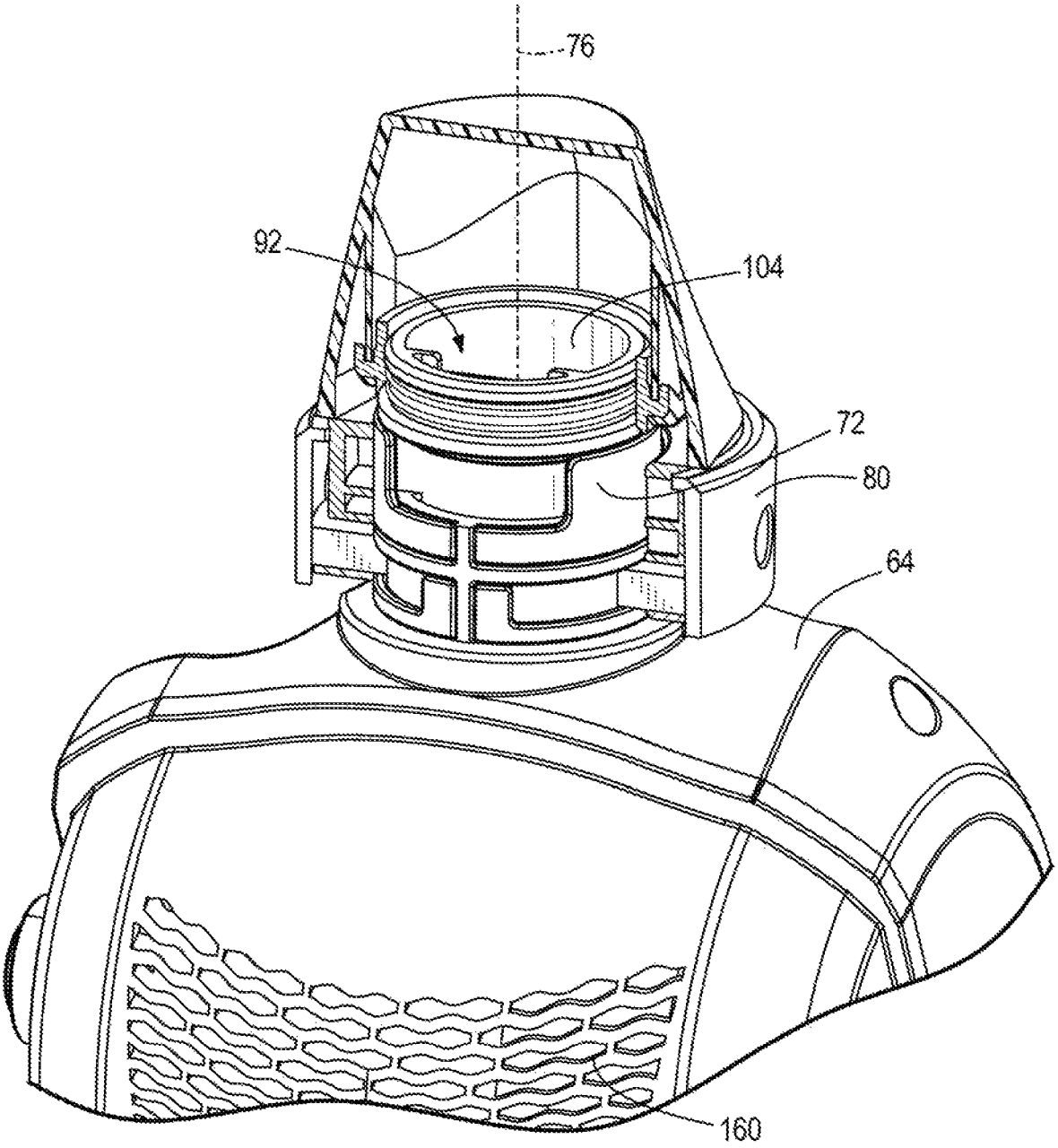
FIG. 5 is a partial cross-sectional view of the vacuum cleaner of FIG. 1 taken along line 5-5 of FIG. 2, with portions removed.
Figure 6:
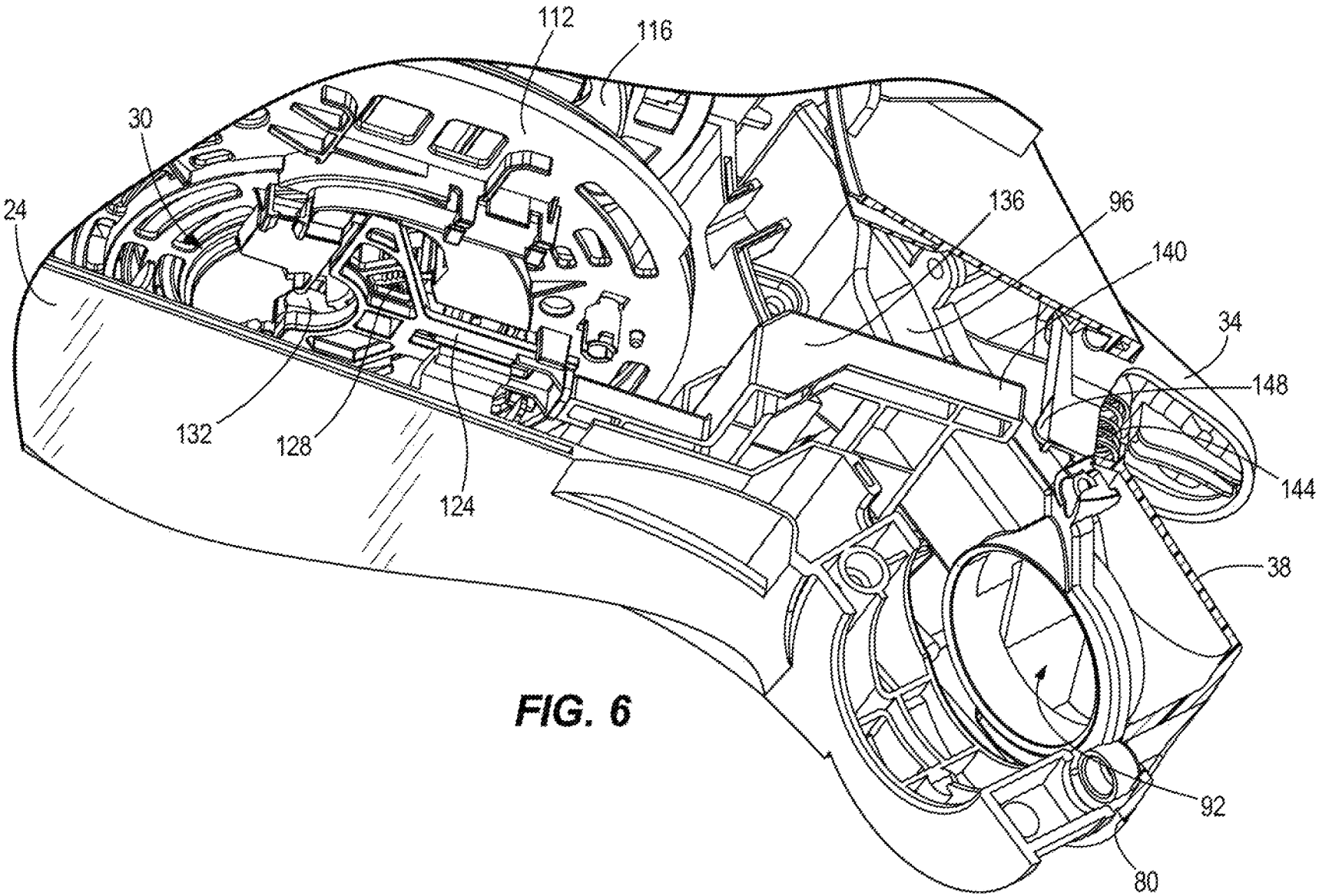
FIG. 6 is a partial cross-sectional view of the vacuum cleaner of FIG. 1, with portions removed.
Figure 7:
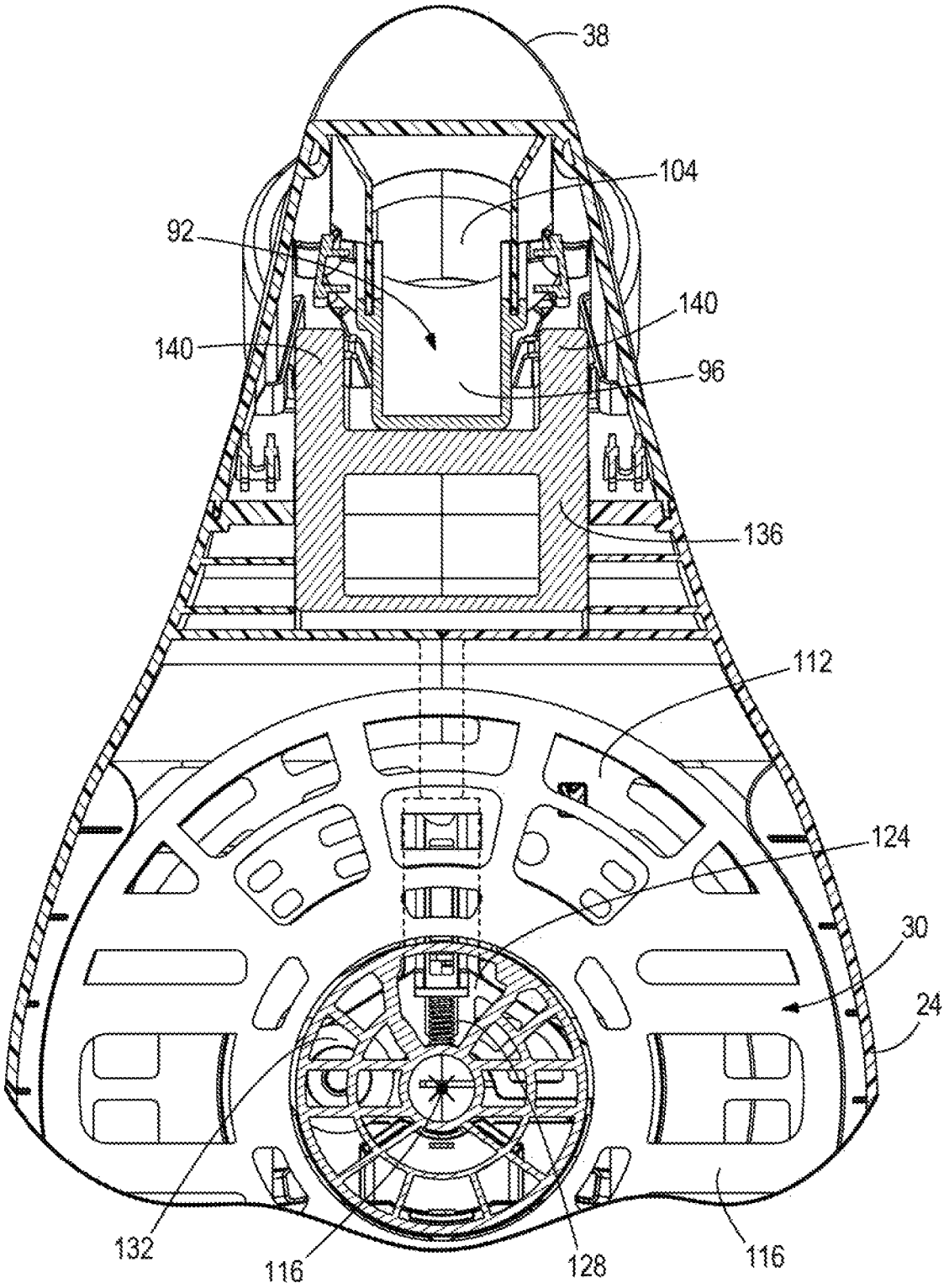
FIG. 7 is a cross-sectional view of the vacuum cleaner of FIG. 1 taken along line 7-7 of FIG. 4, with portions removed.

As shown in FIGS. 1 and 2, the vacuum cleaner 10 includes a foot 42 including a suction opening 46. The vacuum cleaner 10 further includes a suction motor 50 that receives power when the cord 26 is plugged into an AC power source, and a dirt collection chamber 54 with an air treatment member in fluid communication with the suction opening 46 and the suction source 50. The handle assembly 22 includes a grip 56, and is pivotally coupled to the foot 42 for movement about a first pivot axis 68 between an upright position and an inclined position. The handle assembly 22 defines a longitudinal axis 62. The vacuum cleaner 10 also includes a steering assembly 64 coupled between the handle assembly 22 and the foot 42, the steering assembly 64 defining a second pivot axis of rotation 76 that is transverse to the first pivot axis 68, as shown in FIGS. 4A and 4B. The handle assembly 22 is rotatable about the second pivot axis of rotation 76 relative to the foot 42.

In the embodiment illustrated in FIG. 4A, the steering assembly 64 includes a neck 72 that defines the second pivot axis of rotation 76 about which the handle assembly 22 is rotatable relative to the foot 42. Specifically, the handle assembly 22 includes a collar 80 rotatably coupled to the neck 72, such that the handle assembly 22 is rotatable about the axis of rotation 76 via the collar 80 rotating about the neck 72. As shown in FIG. 4A, the axis of rotation 76 is transverse to the first pivot axis 68 and is formed at an acute angle $\alpha$ relative to the longitudinal axis 62 of the handle assembly 22.

In the embodiment illustrated in FIG. 4A, the suction motor 50 is arranged in a motor housing 78 between the handle assembly 22 and the foot 42. The first pivot axis 68 may extend through the motor housing 78 as shown in FIG. 4A. The motor housing 78 may be formed as a part of the steering assembly 64 or may be formed as a part of the handle assembly 22. In other embodiments, such as the embodiment illustrated in FIG. 4B, the suction motor 50 could be arranged elsewhere on the vacuum cleaner 10. In either embodiment, the vacuum cleaner 10 includes an air path made up of a dirty air path 82 that couples the suction opening 46 to the dirt collection chamber 54 and a clean air path 92 that fluidly couples the dirt collection chamber 54 to the suction motor 50, as described in further detail below. Specifically, in the embodiment illustrated in FIGS. 1, 2 and 4A, the dirty air path 82 flows from the suction opening 46 of the foot 42 and through a conduit 84 to an air inlet 88 of the dirt collection chamber 54. Thus, the dirty air path 82 is arranged between the suction opening 46 and the dirt collection chamber 54 and fluidly couples the dirt collection chamber 54 to the suction opening 46. In the illustrated embodiment, the conduit 84 is a flexible hose but in other embodiments, the conduit 84 can be something besides a hose.

In the embodiment illustrated in FIGS. 1, 2 and 4A, the clean air path 92 includes a first channel 96 extending through a spine 100 of the handle assembly 22, a second channel 104 extending through the neck 72 of steering assembly 64, and a third channel 108 extending through the steering assembly 64 to the suction motor 50. After passing through the motor 50, the air is exhausted through an air outlet, which may include a plurality of exhaust vents 160 on the steering assembly 64. Thus, the clean air path 92 fluidly couples the dirt collection chamber 54 to the suction motor 50. As shown in FIG. 4A, the longitudinal axis 62 may extend through a portion of the first channel 96.

The dirt collection chamber 54 includes the air treatment member, which may include one or more cyclones, one or more filters, a bag filter, or a combination of cyclone and filter as desired. After dust and debris is separated from the air stream, the air leaves the dirt collection chamber 54 to the first channel 96 of the clean air path 92. In the illustrated embodiment, the air treatment member includes a cyclonic separator and a filter (not shown). The embodiment illustrated in FIGS. 1, 2 and 4A illustrates the motor 50 in the clean air path 92. However, in other embodiments the motor 50 may be in the dirty air path 82.

In a different embodiment of vacuum cleaner 10 shown in FIG. 4B, a different steering assembly 109 includes a pin 110 arranged in a steering portion 111 coupling the handle assembly 22 to the foot 42. The handle assembly 22 is rotatable about the second pivot axis of rotation 76 via rotation about the pin 110, which is arranged along the second pivot axis of rotation 76. In the embodiment of FIG. 4B, the dirty air path 82 passes from the suction opening 46 through the foot 42 and up through the spine 100 to the suction motor 50 (not shown in FIG. 4B), which is arranged above the cord reel 30. In some embodiments, the suction motor 50 is arranged above the cord reel 30 and below the dirt collection chamber 54. In other embodiments, the cord reel 30 is arranged above the suction motor 50 and below the dirt collection chamber 54. Further, in the embodiment of FIG. 4B, the first pivot axis 68 is defined by a pivot joint 114 on the foot 42.

Figure 3:
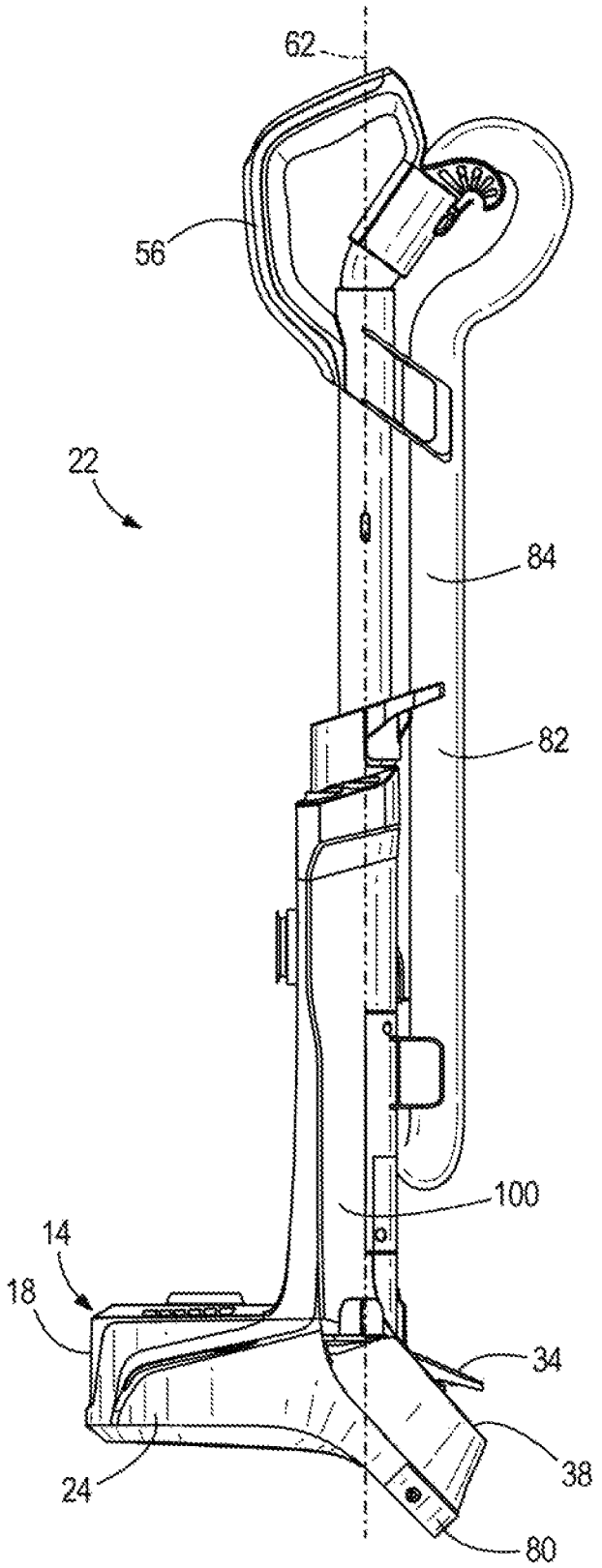
FIG. 3 is a side view of a handle assembly of the vacuum cleaner of FIG. 1.

As shown in FIG. 1-3, the cord reel 30 is arranged under the dirt collection chamber 54 and above the steering assembly 64. As shown in FIGS. 4A, 4B, 6 and 7, the cord reel 30 includes a frame 112 that is fixed to the handle assembly 22 and a spool 116 that holds the cord 26 and is rotatable with respect to the frame 112 about a cord reel axis 116. In the illustrated embodiment, the cord reel axis 116 is parallel to the longitudinal axis 62 of the handle assembly 22. In other embodiments, the cord reel axis 116 may be transverse to the longitudinal axis 62. The cord 26 has been omitted for clarity in FIGS. 4A, 4B, 6 and 7. The cord reel 30 includes a flat spiral spring 120 that turns the spool 116 in a first rotational direction with respect to the frame 112. The cord reel 30 also includes a brake 124 that is moved to a braked position by a compression spring 128 or other mechanism.

The brake 124 is moveable against the force of the spring 128 from the braked position to an unbraked position. Specifically, the brake 124 has a pad 132 that is urged against the spool 116 when the brake 124 is in the braked position. The pressure of pad 132 against spool 116, applied via spring 128, is sufficiently high that the spool 116 will not rotate absent an external force tugging on cord 26. Thus, when the brake 124 is in the braked position, the cord reel 30 is in the second state, in which the cord reel 30 does not wind the cord. However, the pressure of pad 132 against spool 116 is sufficiently low that the spool 116 can rotate in a second rotational direction that is opposite the first rotational direction when an operator pulls on the cord 26. When the brake 124 is moved to the unbraked position, the pad 132 is spaced from the spool 116, switching the cord reel 30 to the first state, in which the cord 26 is wound back onto the cord reel 30. Specifically, when the pad 132 is spaced from the spool 116, the spool 116 is rotated by the flat spiral spring 120 in the first rotational direction to wind the cord 26 onto the cord reel 30.

With continued reference to FIGS. 4A, 4B, 6 and 7, the vacuum cleaner 10 includes a linkage 136 coupled for movement of the brake 124. As shown in the embodiment illustrated in FIGS. 6 and 7, the linkage 136 is positioned external to the first channel 96 of the clean air path 92 and extends around or along a side of the air path 92. Specifically, the linkage 136 includes two legs 140 that are arranged on either side of the first channel 96. Alternatively, the linkage 136 may include one leg that is arranged on one side of the clean air path 92.

In the embodiment shown in FIG. 4B, the linkage 136 is positioned external to the dirty air path 82 and extends around or along a side of the dirty air path 82. In some embodiments, the two legs 140 are arranged on either side of the dirty air path 82. Alternatively, the linkage 136 may include one leg that is arranged on one side of the air dirty path 82. In both embodiments shown in FIGS. 4A and 4B, the actuator 34 is pressed by a compression spring 144 to the first, extended position. As shown in FIGS. 2, 4A and 4B, the actuator 34 is located above the steering assembly 64.

In the illustrated embodiment the actuator 34 is a foot pedal, but in other embodiments the actuator can be a push button, a lever, a handle or other types of actuating members as desired for hand or foot operation. In the illustrated embodiment the actuator 34 is located on the rear side 38 of the handle assembly 22 and located centrally on a lower portion of the handle assembly 22. As used here, the actuator 34 being located centrally does not necessarily mean the exact geometric center of the width of handle assembly 22, but instead is a more general location positioned to provide access to an operator positioned to the rear side of the cleaner 10. In the embodiments shown in FIGS. 4A and 4B, a user-manipulatable portion of the actuator 34 is positioned such that the air path extends between the user-manipulatable portion of the actuator 34 and the cord reel 30. When the actuator 34 is depressed against the force of the compression spring 144 to the second, depressed position, a contact portion 148 of the actuator 34 contacts the legs 140 of the linkage 136 to move linkage 136, and thereby move brake 124 to the unbraked position, thus switching the cord reel 30 to the first state. In alternative embodiments, the linkage 136 is integrally formed with and cantilevered from the actuator 34.

In operation, when an operator prepares to use vacuum cleaner 10, the operator grasps a plug end 152 of the cord 26 and pulls the plug end 152 from the handle assembly 22, drawing the cord 26 through a cord port 156 on the handle assembly 64. As the cord 26 is drawn through the cord port 156, the spool 116 rotates in the second rotational direction, even while pad 132 is pressed against spool 116. If the operator releases the cord 26 while extending it from the vacuum cleaner 10, the cord 26 will not be wound back onto the spool 116, because the cord reel 30 is in the second state. Specifically, the pad 132 is pressed against spool 116 to prevent it from being rotated by the flat spiral spring 120 in the first rotational direction.

The operator moves the handle assembly 22 about the first pivot axis 68 from the upright position to the inclined, operating position. While operating the vacuum cleaner 10, the operator may rotate the handle assembly 22 about the pivot axis of rotation 76 via the collar 80 rotating about the neck 72 of the steering assembly 64 (FIG. 4A), or via the pin 110 within portion 111 (FIG. 4B). If the operator is standing behind the rear side 38 of the handle assembly 22 and rotates the handle assembly 22 clockwise about the second pivot axis of rotation 76, the foot 42 will tend to turn to the right as it is being pushed forwardly. If the operator is standing behind the rear side 38 of the handle assembly 22 and rotates the handle assembly 22 counterclockwise about the second pivot axis of rotation 76, the foot 42 will tend to turn to the left as it is being pushed in a forward direction.

Once the operator has completed vacuuming, the operator unplugs the plug end 152 of the cord from the AC power source, such as the wall outlet. The operator then moves the actuator 34 from the first position to the second position thereby moving the linkage 136 and the brake 124 towards the cord reel axis 116, such that pad 132 is separated from the spool 116. The cord reel 30 is accordingly switched to the first state and the spool 116 is then rotated by the flat spiral spring 120 in the first rotational direction to retract the cord.

Although the invention has been described in detail with reference to certain preferred embodiments, variations and modifications exist within the scope and spirit of one or more independent aspects of the invention as described.

The invention claimed is:

1. A vacuum cleaner comprising:

a foot including a suction opening;

a suction source;

a dirt collection chamber in fluid communication with the suction opening and the suction source;

an air path extending from the suction opening to an air outlet in fluid communication with the suction source and the dirt collection chamber; and a handle assembly pivotally coupled to the foot for movement between an upright position and an inclined position about a first pivot axis, the handle assembly including a cord reel assembly arranged on a front side of the handle assembly and an actuator centrally arranged on a rear side of the handle assembly, wherein the cord reel assembly includes a cord reel and a cord configured to be coupled to an AC power source and provide power to the suction source, the cord reel switchable between a first state, in which the cord reel winds the cord, and a second state, in which the cord reel does not wind the cord, wherein the actuator is moveable between a first position and a second position, and wherein in response to the actuator moving from the first position to the second position, the cord reel switches from the second state to the first state, and wherein a portion of the air path extends adjacent a linkage positioned external to the air path and coupling the actuator to the cord reel, the linkage moveable between a first position, corresponding to the first position of the actuator, and a second position, corresponding to the second position of the actuator and in which the linkage switches the cord reel from the second state to the first state.

2. The vacuum cleaner of claim 1, wherein the linkage is integrally formed with the actuator.

3. The vacuum cleaner of claim 1, further comprising a steering assembly coupled between the handle assembly and the foot, the steering assembly defining a second pivot axis of rotation transverse to the first pivot axis about which the handle assembly is rotatable relative to the foot.

4. The vacuum cleaner of claim 1, wherein the air path passes through the steering assembly.

5. The vacuum cleaner of claim 1, wherein a portion of the actuator or the linkage extends around the air path.

6. The vacuum cleaner of claim 1, wherein the air path extends between a user-manipulatable portion of the actuator and the cord reel.

7. The vacuum cleaner of claim 1, further comprising a steering assembly coupled between the handle assembly and the foot, the steering assembly defining a second pivot axis of rotation transverse to the first pivot axis about which the handle assembly is rotatable relative to the foot.

8. The vacuum cleaner of claim 7, wherein the air path passes through the steering assembly.

9. The vacuum cleaner of claim 7, wherein the dirt collection chamber is positioned on the handle assembly and the cord reel is arranged under the dirt collection chamber and above the steering assembly.

10. A vacuum cleaner comprising:

a foot including a suction opening;

a suction source;

a dirt collection chamber in fluid communication with the suction opening and the suction source;

an air path extending from the suction opening to an air outlet in fluid communication with the suction source and the dirt collection chamber; and a handle assembly pivotally coupled to the foot for movement between an upright position and an inclined position about a first pivot axis, the handle assembly including a cord reel assembly arranged on a front side of the handle assembly and an actuator centrally arranged on a rear side of the handle assembly, wherein the cord reel assembly includes a cord reel and a cord configured to be coupled to an AC power source and provide power to the suction source, the cord reel switchable between a first state, in which the cord reel winds the cord, and a second state, in which the cord reel does not wind the cord, wherein the actuator is moveable between a first position and a second position, and wherein in response to the actuator moving from the first position to the second position, the cord reel switches from the second state to the first state, the vacuum cleaner further comprising a steering assembly coupled between the handle assembly and the foot, the steering assembly defining a second pivot axis of rotation transverse to the first pivot axis about which the handle assembly is rotatable relative to the foot, wherein a portion of the air path extends between a user-manipulatable portion of the actuator and the cord reel.

11. The vacuum cleaner of claim 10, wherein the portion of the air path between the actuator and cord reel includes a dirty air path arranged between the suction opening and the dirt collection chamber.

12. The vacuum cleaner of claim 10, wherein the portion of the air path between the actuator and cord reel includes a clean air path arranged between the dirt collection chamber and the suction source.

13. A vacuum cleaner comprising:

a foot including a suction opening;

a suction source;

a dirt collection chamber in fluid communication with the suction opening and the suction source;

an air path extending from the suction opening to an air outlet in fluid communication with the suction source and the dirt collection chamber; and a handle assembly pivotally coupled to the foot for movement between an upright position and an inclined position about a first pivot axis, the handle assembly including a cord reel assembly arranged on a front side of the handle assembly and an actuator centrally arranged on a rear side of the handle assembly, wherein the cord reel assembly includes a cord reel and a cord configured to be coupled to an AC power source and provide power to the suction source, the cord reel switchable between a first state, in which the cord reel winds the cord, and a second state, in which the cord reel does not wind the cord, wherein the actuator is moveable between a first position and a second position, and wherein in response to the actuator moving from the first position to the second position, the cord reel switches from the second state to the first state, the vacuum cleaner further comprising a steering assembly coupled between the handle assembly and the foot, the steering assembly defining a second pivot axis of rotation transverse to the first pivot axis about which the handle assembly is rotatable relative to the foot, wherein a portion of the actuator extends around a side of the air path.

14. A vacuum cleaner comprising:

a foot including a suction opening;

a suction source;

a dirt collection chamber in fluid communication with the suction opening and the suction source;

an air path extending from the suction opening to an air outlet in fluid communication with the suction source and the dirt collection chamber;

a handle pivotally coupled to the foot for movement about a first pivot axis between an upright position and an inclined position;

a steering assembly coupled between the handle and the foot, the steering assembly defining a second pivot axis of rotation transverse to the first pivot axis, wherein the handle is rotatable about the second pivot axis relative to the foot;

a cord reel assembly including a cord reel and a cord that is configured to be coupled to an AC power source and provide power to the suction source, the cord reel switchable between a first state, in which the cord reel winds the cord, and a second state, in which the cord reel does not wind the cord; and an actuator moveable between a first position and a second position, wherein in response to the actuator moving from the first position to the second position, the cord reel switches from the second state to the first state, and wherein the air path extends between a user-manipulatable portion of the actuator and the cord reel.

15. The vacuum cleaner of claim 14, wherein the air path passes through the steering assembly.

16. The vacuum cleaner of claim 14, wherein the suction source is arranged in a motor housing, and wherein the first pivot axis extends through the motor housing.

17. The vacuum cleaner of claim 14, wherein the actuator is located above the steering assembly.

18. The vacuum cleaner of claim 14, wherein the cord reel is arranged under the dirt collection chamber and above the steering assembly.

19. The vacuum cleaner of claim 14, wherein the second pivot axis is formed at an acute angle relative to a longitudinal axis of the handle.

20. A vacuum cleaner comprising:

a foot including a suction opening;

a suction source;

a dirt collection chamber in fluid communication with the suction opening and the suction source;

an air path extending from the suction opening to an air outlet in fluid communication with the suction source and the dirt collection chamber;

a handle pivotally coupled to the foot for movement about a first pivot axis between an upright position and an inclined position;

a steering assembly coupled between the handle and the foot, the steering assembly defining a second pivot axis of rotation transverse to the first pivot axis, wherein the handle is rotatable about the second pivot axis relative to the foot;

a cord reel assembly including a cord reel and a cord that is configured to be coupled to an AC power source and provide power to the suction source, the cord reel switchable between a first state, in which the cord reel winds the cord, and a second state, in which the cord reel does not wind the cord; and an actuator moveable between a first position and a second position, wherein in response to the actuator moving from the first position to the second position, the cord reel switches from the second state to the first state, the vacuum cleaner further comprising a linkage positioned external to the air path and coupling the actuator to the cord reel, the linkage moveable between a first position, corresponding to the first position of the actuator, and a second position, corresponding to the second position of the actuator and in which the linkage switches the cord reel from the second state to the first state.

21. The vacuum cleaner of claim 20, wherein the air path extends between a user-manipulatable portion of the actuator and the cord reel.

22. A vacuum cleaner comprising:

a foot including a suction opening;

a suction source;

a dirt collection chamber in fluid communication with the suction source;

a handle pivotally coupled to the foot for movement between an upright position and an inclined position;

an air path fluidly coupling the suction opening to an air outlet, the air path in fluid communication with the suction source and the dirt collection chamber, the air path at least partially within the handle;

a cord reel assembly including a cord reel and a cord that is configured to be coupled to an AC power source and provide power to the suction source, the cord reel arranged on a front side of the handle, the cord reel switchable between a first state, in which the cord reel winds the cord, and a second state, in which the cord reel does not wind;

an actuator moveable between a first position and a second position, the actuator arranged on a rear side of the handle; and a linkage coupling the actuator to the cord reel, the linkage positioned external to the air path and movable between a first position, corresponding to the first position of the actuator, and a second position, corresponding to the second position of the actuator and in which the linkage switches the cord reel from the second state to the first state.

23. The vacuum cleaner of claim 22, wherein the actuator is integrally formed with the linkage.

24. The vacuum cleaner of claim 22, wherein the air path extends between a user-manipulatable portion of the actuator and the cord reel.

25. The vacuum cleaner of claim 22, wherein the air path includes a dirty air path arranged between the suction opening and the dirt collection chamber, and wherein the linkage is arranged external to the dirty air path.

26. The vacuum cleaner of claim 22, wherein the air path includes a clean air path arranged between the dirt collection chamber and the suction source, and wherein the linkage is arranged external to the clean air path.

27. The vacuum cleaner of claim 22, wherein the air path passes through the steering assembly.

* * * * *